United States Patent [19]

Becker et al.

[11] 4,422,235

[45] Dec. 27, 1983

[54] TOOL FOR JOINING CONNECTORS

[75] Inventors: Edward W. Becker, Winder; Paul R. Harville, Lilburn, both of Ga.; Glen E. MacLeod, Los Angeles, Calif.

[73] Assignee: Bell Telephone Laboratories, Incorporated, Murray Hill, N.J.

[21] Appl. No.: 338,120

[22] Filed: Jan. 8, 1982

[51] Int. Cl.[3] ..... H01R 43/04

[52] U.S. Cl. ..... 29/749; 29/566.3; 29/751

[58] Field of Search ..... 29/749, 751, 753, 566.3, 29/566.4, 252

[56] References Cited

U.S. PATENT DOCUMENTS 3,772,635 11/1973 Frey et al. ..... 339/99 R
3,858,158 12/1974 Henn et al. ..... 339/99 R
4,148,138 4/1979 Becker et al. ..... 29/749
4,307,505 12/1981 Jozens ..... 29/749 X

OTHER PUBLICATIONS

710 Connector Handbook, Oct. 1975, pp. 26 and 33.

*Primary Examiner*—Carl E. Hall
*Attorney, Agent, or Firm*—H. L. Newman

[57] ABSTRACT

A new tool for assembling stackable elements with multiple conductors is disclosed. The new tool consists of a connector holding bracket 101 for retaining the elements and conductors, a T-bar assembly 120 for applying forces to cut conductors and press stackable elements together, and a support assembly 105 which includes a hydraulic system which positions the T-bar assembly 120.

19 Claims, 10 Drawing Figures

TOOL FOR JOINING CONNECTORS

FIELD OF THE INVENTION

This invention relates to a connector assembly tool and more particularly to a hand operated tool which may be used in field and factory environments to assemble elements of a connector and to assemble insulated conductors to elements of the connector.

BACKGROUND OF THE INVENTION

A number of different connecting devices are used in the communications industry to splice together conductors of cables.

One type of multiple contact connector, which is disclosed in U.S. Pat. No. 3,858,158, is commonly referred to as a stackable connector and includes an index strip and a connector module. The index strip and connector module both include a row of conductor receiving grooves equally spaced along their upper surface, while the connector module further includes a metallic contact underlying each groove and having a conductor receiving slot at its upper and lower end. In use, an individual insulated conductor from a first group of conductors is positioned in each conductor receiving groove of the index strip. The conductors are then forceably seated in the grooves, and the ends of the conductors extending beyond the index strip are trimmed off. The conductor module is thereafter pressed into engagement with the index strip, resulting in the conductor receiving slots in the lower ends of the contacts cutting through the insulation of and the contacts making electrical connection with the conductors of the first group. Conductors of a second group which are to be electrically interconnected to those of the first group are then inserted into the conductor receiving grooves of the connector module. The assembly is completed by these conductors being forceably pressed down into the conductor receiving slots at the upper end of the contacts whereby the contacts cut through the insulation of and make electrical connection with these conductors. The ends of the conductors extending beyond the connector module are thereafter trimmed off.

It should be apparent that tools which are used to assemble multiple contact, stackable connectors of this type must be capable of imparting sufficient forces to elements of the connector to secure them together. Further, such tools must have the capability of seating conductors within plastic and metallic portions of the connector and of severing excess lengths of the conductors. Finally, such tools should include a means for adjusting to the varying heights of the stackable assembly so that excessive forces are not applied with resulting damage to the connector or the tool.

A hand-operated connector assembly tool is described in U.S. Pat. No. 4,148,138 by Becker et al issued on Apr. 10, 1979 that requires a mechanical slide spacer to position the tool. The slide spacer allows the tool to be moved through discrete incremental distances corresponding to the heights of the stackable connector elements for which the slide spacer is designed.

Thus, the tool is limited to a connector for which the discrete incremental heights provided by the slide spacer are effective. If the tool is to be used with other connectors then a modification of the tool is required which entails changing the slide spacer. This change usually involves either a reshaping of the spacer originally within the tool or its replacement by a new slide spacer. In either case, the tool must be removed from service for a period of time.

Our invention is an improvement on the tool described in the before-mentioned patent of Becker et al. It is simpler and easier to operate. It also requires less maintenance than the prior art tool and is more reliable. Finally our tool does not require modification to accommodate different incremental heights of connectors and is force limited rather than displacement limited, thus preventing possibility of an overload which could damage the tool or connector.

SUMMARY OF THE INVENTION

A tool in accordance with the present invention comprises a mounting assembly, a connector holding bracket which sits atop the mounting and a T-bar assembly which moves up and down in relation to the mounting assembly. The mounting assembly includes a hydraulic system that acts as the spacer for the different incremental heights of connector elements and allows for the release of pressure.

The hydraulic system utilized consists of a housing which includes two chambers contained within it. A passageway connects the chambers such that hydraulic fluid can flow therebetween. There is a relief valve between chambers. A first chamber contains a piston attached to the T-bar assembly and a coil spring that extends between the piston and the housing. The second chamber contains a diaphragm which is exposed to the atmosphere through holes in the side of the housing. The passageway between the chambers contains a poppet valve that when in an open position allows fluid to flow freely between the chambers. The valve includes a spring that braces it toward a closed position, but it is held in the open position by an operating lever that is part of the T-bar assembly. This lever when in its rest position engages a poppet valve actuator, which is located on the outside of the mounting assembly, to maintain the valve in the open position.

In the operation of the tool, the T-bar assembly, which performs the pressing-cutting operation, is pushed downward, causing the attached piston to move downward in the first chamber a corresponding distance. Hydraulic fluid located in the second chamber fills the void created by the piston. The diaphragm, due to the atmospheric pressure, expands to occupy the area evacuated by the fluid in the second chamber. After the T-bar assembly has been pushed down a sufficient distance to engage one of the connector elements, the operating lever is pulled back, allowing the spring operated poppet valve to close. This prevents the passage of fluid between chambers and thus locks the T-bar assembly in the engaged position. The operating lever is then pulled back a further distance and a cam connected to the lever moves part of the T-bar assembly down a further distance to perform the pressing-cutting operation. This results in the mounting assembly housing being pressed toward the piston whereby the pressure in the first chamber is increased. When the pressure reaches a predetermined value, the relief valve opens momentarily, allowing some fluid to flow from the first chamber to the second chamber to thereby relieve the pressure in the first chamber.

The hydraulic system allows for a so-called "infinite" adjustment for different connector assemblies that is limited only by the allowable stroke of the piston. This hydraulic system is therefore used as a displacement or spacing system rather than as a force applying system.

DETAILED DESCRIPTION

Figure 1:
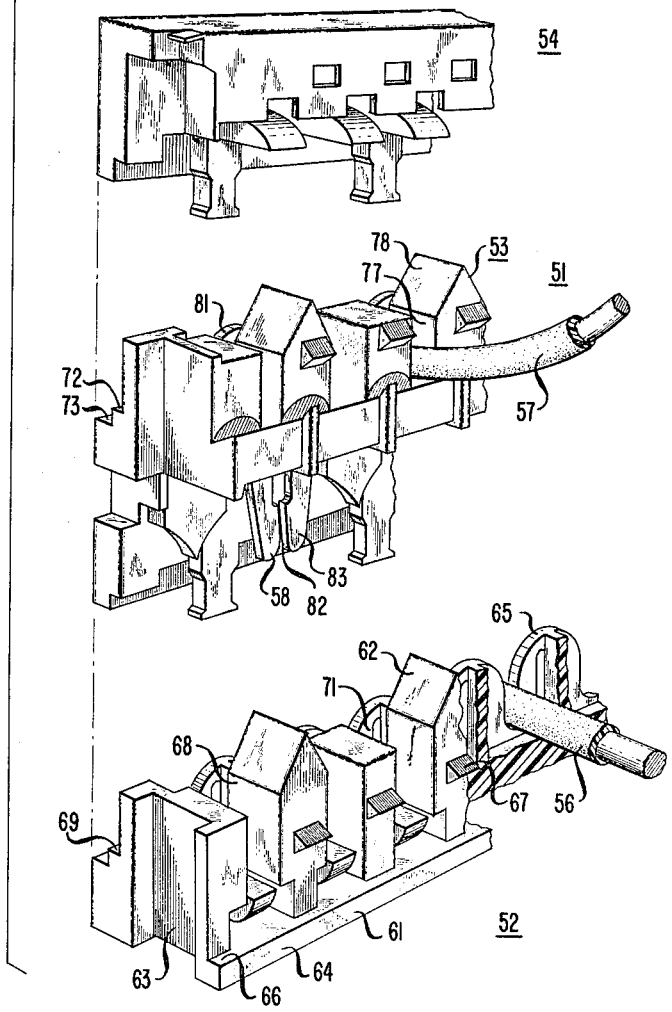
FIG. 1 is an exploded view of elements of a stackable multi-contact connector for connecting together insulated conductors.

FIG. 1 is an electrical connector which is designated generally by the numeral 51. The electrical connector which is disclosed and claimed in U.S. Pat. No. 3,858,158, includes an index strip, designated generally by the numeral 52, a connector module designated generally by the numeral 53, and a cap designated generally by the numeral 54.

The connector 51 includes a plurality of slotted double-ended contact elements 58–58 for connecting together at least one or more conductors 56—56 of a first group of conductors to associated conductors 57—57 of a second group. The lower end of each contact element 58—58 is received in the index strip 52 when the connector module 53 is mounted thereon to slice through the insulation of and electrically engage an associated conductor 56—56 held in the index strip. The upper end (not shown) of each contact element 58—58 slices through the insulation of and electrically engages an aligned end of an associated conductor 57—57 when these conductors are seated in the connector module 53.

As seen in FIG. 1, the index strip 52 includes a base 61 having a plurality of spaced teeth 62—62 projecting vertically from the base between grooved end walls 63—63 to form a plurality of conductor receiving grooves 68—68. Each of the teeth 62—62 includes a nub 67 on one side surface thereof for securing the module 53 to the index strip 52. A platen surface 69 is formed lengthwise along the index strip 52 adjacent to risers 65—65 to serve as an anvil to facilitate the severance of the ends of the conductors 56—56 which extend beyond the index strip 52. The index strip 52 also has a plurality of wells 71—71 which are formed between adjacent teeth 62—62 and risers 65—65 for receiving ends of the contact elements 58—58 of the connector module 53 mounted on the index strip 52.

The connector module 53 which is configured so as to be mounted or stacked on the index strip 52 includes a plurality of the contact elements 58—58. An upper portion of the connector module 53 terminates along a ledge 72 spaced below a platen 73 (see FIG. 1) which serves as a conductor cutting anvil. A plurality of latch openings (not shown) open to a side wall of the connector module 53 to receive latching nubs 67—67 of the index strip 52 to secure the connector module 53 to the index strip 52. The connector module 53 also includes a plurality of conductor-receiving grooves 77—77 for holding conductors 57—57.

The assembly of connector 51 is completed with the cap 54, which is described in above-identified U.S. Pat. No. 3,772,635 and which is assembled to the connector module 53 to protect the bifurcated beams 83—83 and conductors 57—57 from moisture and other contaminants.

Figure 2:
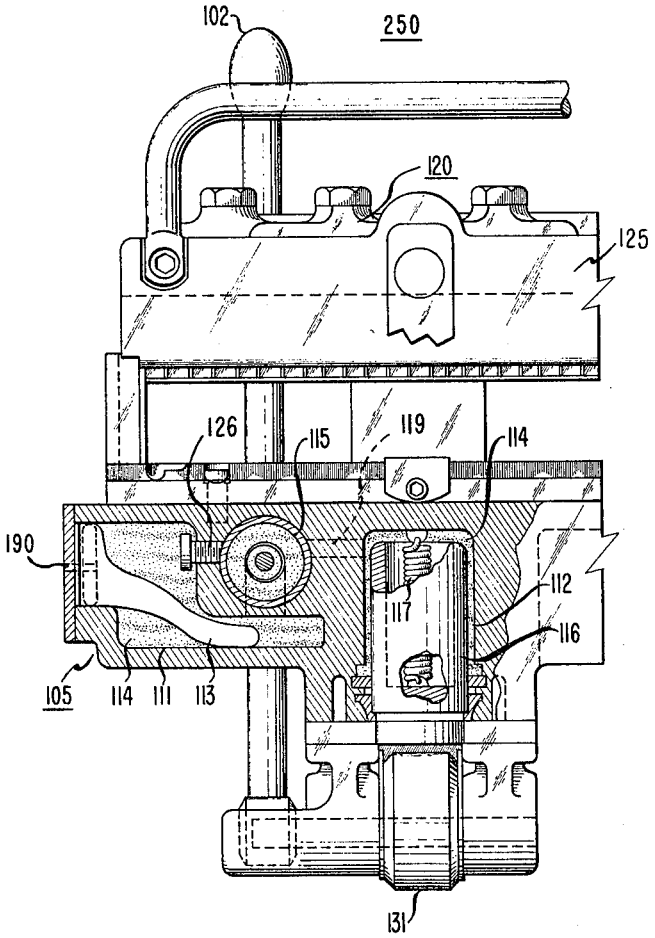
FIG. 2 is a back elevational view of the tool in an initial position with a portion of the housing removed to disclose the hydraulic system of the tool.
Figure 5:
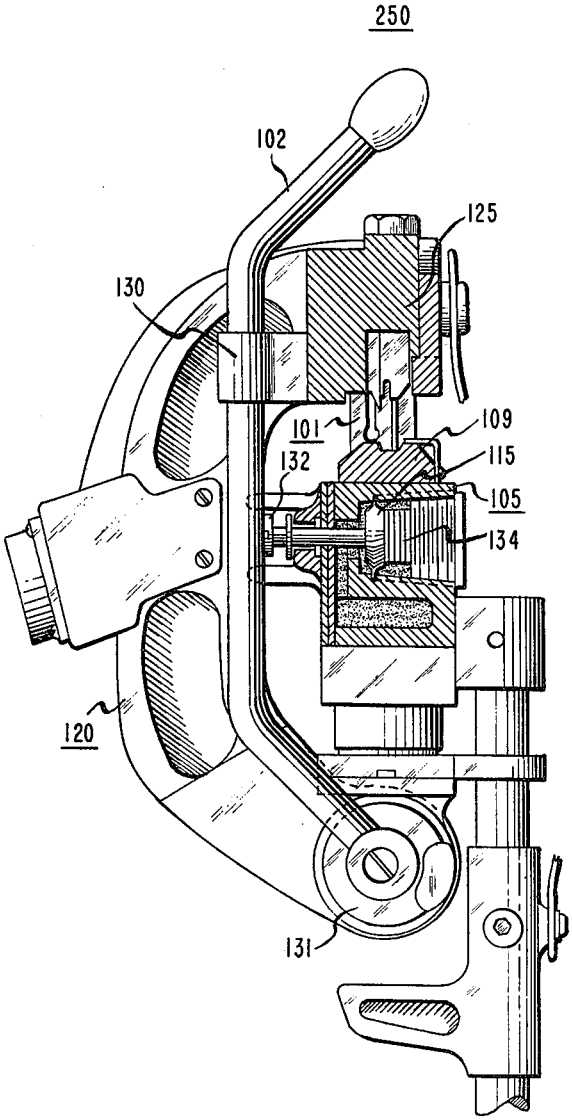
FIG. 5 is the same view as FIG. 3 except the tool is in a position to press and cut connectors and conductors respectively.
Figure 6:
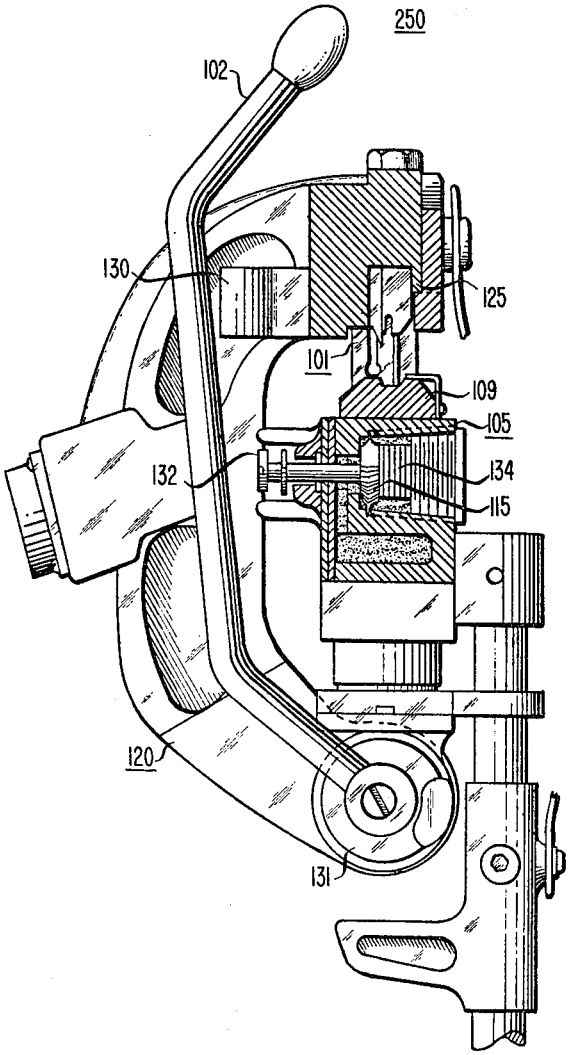
FIG. 6 is the same view as FIGS. 3 and 5 except the handle of the T-bar assembly has been moved to a position away from the housing to close poppet value.

In the use of the tool 250 (see FIGS. 2 through 6) to assemble elements of the connector 51 and conductors 56—56 and 57—57 which are to be spliced together, an installer positions an index strip 52 in a support which is referred to as a holding bracket assembly and which is designated generally by the numeral 101 (see FIGS. 2 and 5).

The installer also inserts one of the conductors 56—56 in each one of the conductor receiving grooves 68—68 so that in the first sequence of steps of the operation of the tool 250, they are seated firmly in the grooves. It should be noted that the conductor-receiving grooves in the elements of connector 51 are configured such that when an installer inserts conductors therein, the conductors are gripped by the walls of the grooves and held until they are seated during the operation of the tool 250.

The tool 250 comprises a holding bracket assembly 101, T-bar assembly 120, and mounting assembly 105. The holding bracket assembly and T-bar assembly are described fully in U.S. Pat. No. 4,148,138 and are thereby incorporated by reference herein. The holding bracket assembly 101 retains the stackable elements and conductors to form the connector 53. Holding bracket assembly 101 sits on top of the mounting assembly 105. The T-bar assembly (120) is a force-applying member. This assembly contains a head 125 which during each sequence of steps of the assembly is moved through a first incremental distance to engage a topmost connector element held in the holding bracket assembly 101. Then assembly 120 is moved through a second incremental distance to seat and cut conductors or to assemble together connector elements in position on the plate 109.

Looking at FIG. 2, which is a back view of the the tool in an "at rest" position, the mounting assembly 105 consists of a housing 110 which contains two chambers 111 and 112. In chamber 111 is a flexible diaphragm 113, which can be a flexible plastic sleeve, and also hydraulic fluid 114. A poppet valve 115 is located in a passageway 119 extending between the two chambers. A spring 134 associated with the poppet valve acts to move the poppet valve to a closed position. Chamber 112 has a piston 116 therein which is attached to and therefore moves with the T-bar assembly 120 in response to a downward force on the T-bar assembly. A spring 117, which is attached internally between piston 116 and housing 110, acts to move the piston and thereby the T-bar assembly 105 upward. Passageway 119 allows hydraulic fluid 114 to flow freely between chambers 111 and 112 when the poppet valve 115 is open.

Figure 3:
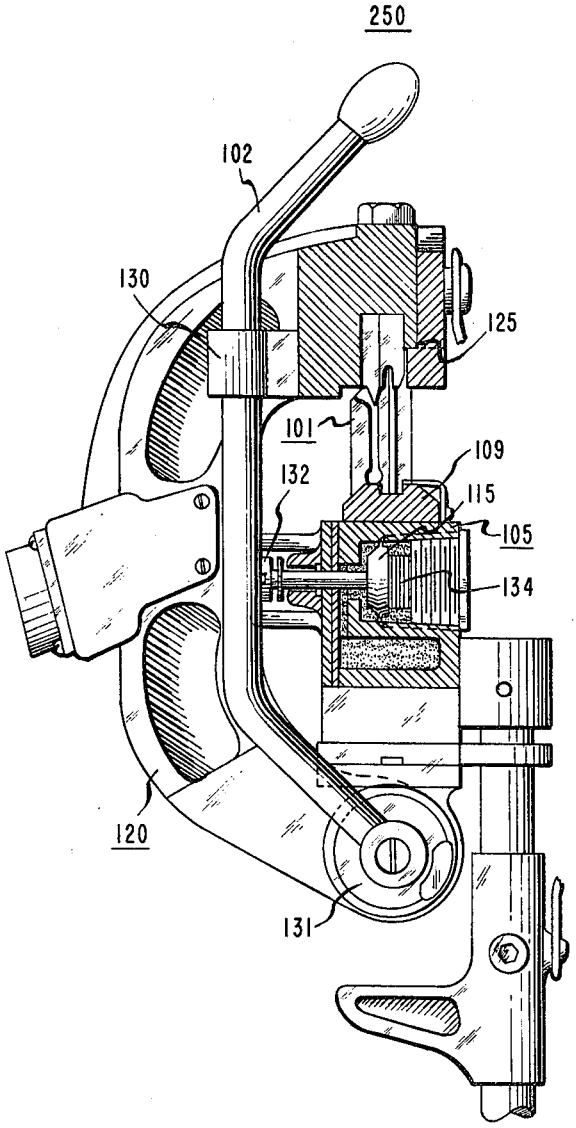
FIG. 3 is a side elevational cutaway view of the tool in an initial position with a portion of the housing removed to disclose the hydraulic system.
Figure 4:
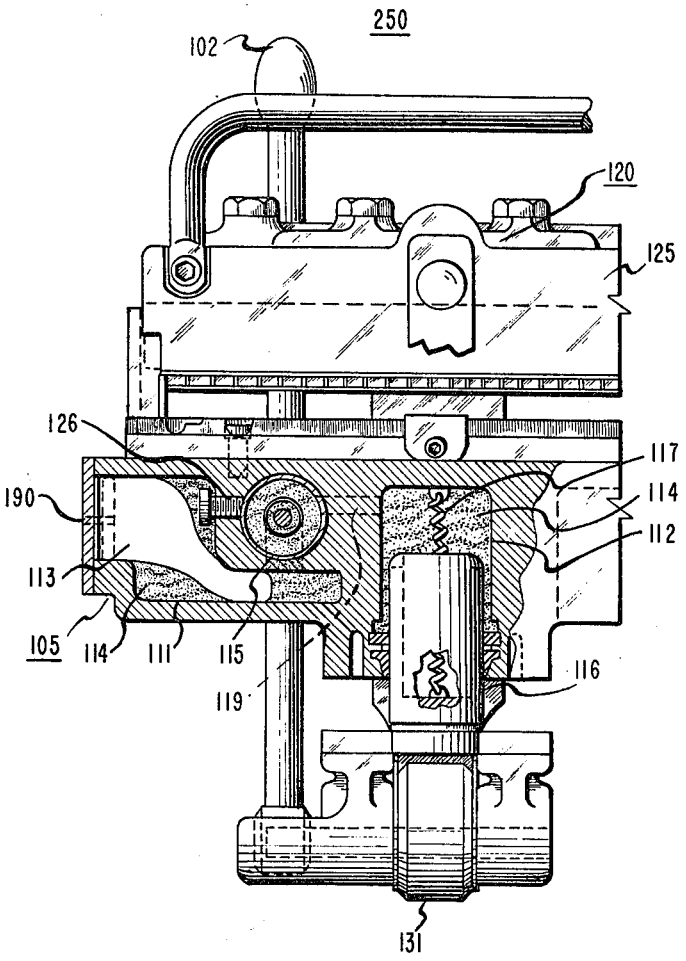
FIG. 4 is the same view as FIG. 2 except the tool is in a position to press and cut connectors and conductors respectively.

FIG. 3 shows a side view of the tool in the "at rest" position. As can be seen the poppet valve 115 is held open by an operating lever 102 that is part of the T-bar assembly 120. A clip 130 holds the lever 102 in place prior to the pressing and cutting action. FIG. 2 also shows that most of the hydraulic fluid 114 is in chamber 111 as the piston occupies the area of chamber 112. Diaphragm 113 is exposed to the atmosphere through holes in a diaphragm cap 190 in the side of housing 110. Since most of the fluid 114 is located in chamber 111, the diaphragm is in a deflated state.

In the use of the tool, a connector element is placed in the holding bracket 101, and then the T-bar assembly 120 is pressed down into engagement with the top of the connector element. As the T-bar moves down, the piston 116 moves with it and, as seen from FIGS. 4 and 5, hydraulic fluid 114 flows into the area evacuated by the piston 116 through poppet valve 115. The diaphragm expands due to the reduction of the volume of fluid in chamber 111 and its exposure to atmospheric pressure through the holes in diaphragm cap 190.

Upon pulling operating lever 102 back from its holder 130 (FIG. 6), the poppet valve actuator 132 is moved outwardly by spring 134, and the valve 115 thereby closes the passageway 119, the valve 115 which seals off closing the passageway 119, preventing fluid 114 from flowing freely back and forth between chambers. This locks the T-bar assembly in position. The operating lever 102 is then pulled back further to press connector elements together and seat conductors in a connector element and cut off the ends of the conductors. This is accomplished through operation of cam 131 in much the same way as described in U.S. Pat. No. 4,148,138. An adjustable relief valve 126 is provided to allow some fluid 114 to flow back to chamber 111 from chamber 112 if the pressure at which relief valve 126 is set is exceeded. Therefore, a predetermined pressure is reached, it provides for a uniform load to be applied to a connector 51 and prevents damage to the tool 250 or connector 51.

In this embodiment therefore a change in the connector elements or conductor heights does not require a modification of the tool. There is in essence an inifinite adjustment available for dealing with the different heights of connector elements limited only by the stroke of the piston. Therefore, rather than using a displacement limited spacer, adjustable in incremental steps only, as a force applying unit, it uses a force-limited hydraulic system that is infinitely adjustable within the range of the piston stroke.

Figure 7:
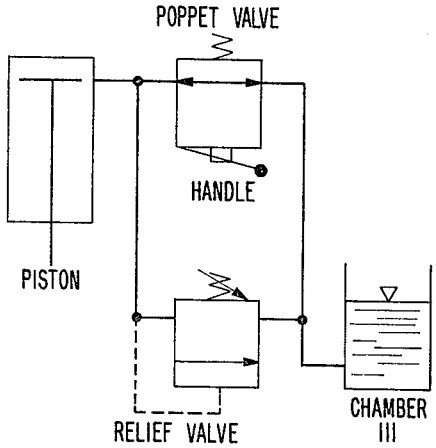
FIGS. 7–10 are diagrams of the operation of the hydraulic system of the tool.
Figure 8:
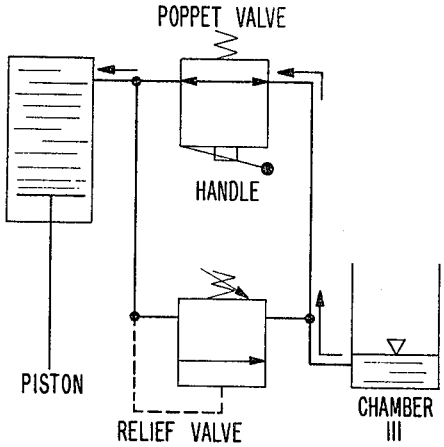
Figure 9:
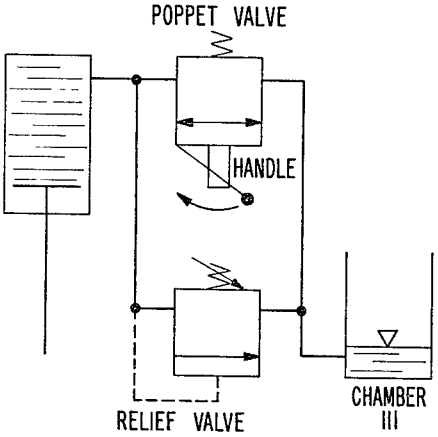
Figure 10:
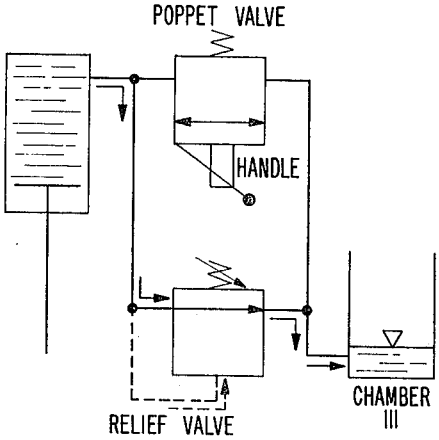

The schematic diagram of the hydraulic system (FIGS. 7 through 10) of the tool more particularly indicates the sequence of operation of the tool. As can be seen, FIG. 7 is the initial state. The poppet valve is open and the piston is in the up position and chamber 111 contains most of the fluid. When a downward force is applied to the T-bar assembly in FIG. 8, the piston moves down and fluid flows from chamber 111 to the area evacuated by the piston through passageway 119. Then in FIG. 9 the lever 102 is pulled back, releasing the actuator 132 of the poppet valve 115, the poppet valve thereby closes off passageway 119 and thus prevents fluid from flowing between the two chambers and locking the T-bar assembly in position. As the handle is pulled through its full stroke force is applied to the connector through the cam acting on the T-bar 120. The resulting reaction of the T-bar against the piston 116 increases the pressure in chamber 112. Once enough force is applied through T-bar 120 to press and cut the conductors, the relief valve 126 relieves the pressure at a predetermined level and allows fluid to pass from chamber 112 to chamber 111. After the cutting and pressing actions have taken place, the handle is returned to its original position. As a result, the poppet valve actuator 132 is moved inwardly and the poppet valve 115 is opened, permitting fluid to flow between the chambers. The piston 116 and thereby the T-bar assembly 120 move back up due to the action of the spring 117, thereby forcing most of the fluid back into chamber 111.

This tool is simpler to operate and less expensive than the prior art. It allows for an infinite adjustment limited only by the stroke of the piston. This invention will find use in factory or field environments where a portable tool is necessary to connect or splice large numbers of conductors.

While this invention has been disclosed by means of a specific illustrative embodiment the principles thereof are capable of a wide range of modification by those skilled in the art within the scope of the following claims.

What is claimed is:

1. A tool for assembling a connector including a plurality of elements, the tool comprising:
   - means for supporting connector elements during their assembly;
   - means for applying a force to a particular element positioned in the supporting means;
   - means for mounting the force applying means for reciprocal movement between a first and second position; the mounting means including:
   - first and second chambers with a passageway therebetween;
   - fluid contained within the first and second chambers and the passageway;
   - means responsive to the movement of the force applying means for transferring fluid from one chamber to another; and
   - means for blocking the flow of fluid between the chambers to hold the force applying means in a particular position.

2. A tool as in claim 1 wherein the fluid transferring means is connected to the force applying means.

3. A tool as in claim 2 wherein the fluid transferring means comprises a piston positioned within one of the chambers.

4. A tool as in claim 1 wherein the flow blocking means comprises a valve in the passageway.

5. A tool as in claim 4 wherein the force applying means includes an operating lever that in its rest position maintains the valve in an open condition, the operating lever when moved from its rest position permitting the valve to close.

6. A tool as in claim 1 wherein the mounting means further includes means for preventing the force applied to a connector element by the force applying means from exceeding a predetermined level.

7. A tool for assembling stackable elements to form a connector and for assembling conductors to the elements which comprises;
   - means for supporting the connector during its assembly in which adjacently positioned elements are secured together to form a stack of elements and conductors are assembled to said elements;
   - means for applying forces to each successively stacked element positioned in the supporting means to secure it to an adjacent element previously positioned in the supporting means and for applying forces to the conductor to assemble the conductors to the elements;

means for mounting the force applying means for up and down movement between a first and second position, the mounting means including:

first and second chambers with a passageway therebetween;

fluid contained within the first and second chambers and the passageway;

means in the first chamber responsive to the downward movement of the force applying means for transferring fluid from the second chamber to the first chamber; and means for blocking the flow of fluid between the chambers to hold the force applying means in a particular position.

8. A tool as in claim 7 wherein the fluid transferring means comprises a piston connected to the force applying means, the piston moving up and down with the force applying means.

9. A tool as in claim 8 wherein the first chamber further includes means acting to return the piston and thereby the force applying means to an upward position whereby fluid is transferred back from the first chamber to the second chamber.

10. A tool as in claim 7 wherein the fluid is hydraulic and the second chamber includes means for filling the space occupied by the fluid transferred from the second chamber to the first chamber.

11. A tool as in claim 10 wherein the space filling means comprises a diaphragm, one surface of which is in engagement with the hydraulic fluid and the other surface of which is exposed to atmospheric pressure.

12. A tool for assembling stackable elements to form a connector and for assembling conductors to the elements which comprises;

means for supporting the connector during its assembly in which adjacently positioned elements are secured together to form a stack of elements and conductors are assembled to said elements;

means for applying forces to each successively stacked element positioned in the supporting means to secure it to an adjacent element previously positioned in the supporting means and for applying forces to the conductor to assemble the conductors to the elements, the force applying means including an operating lever for causing the force applying action, the lever being movable between a rest position and an operating position;

means for mounting the force applying means for up and down movement between and first and second position;

the mounting means including:

first and second chambers with a passageway therebetween;

hydraulic fluid contained within the first and second chambers and the passageway;

a piston positioned within the first chamber, the piston being connected to and moving up and down with the force applying means; and a valve positioned in the passageway, the valve being held in an open condition when the operating lever of the force applying means is in its rest position to permit flow of hydraulic fluid between the chambers, and the valve closing when the operating lever is moved from its rest position to block the flow of hydraulic fluid.

13. A tool for assembling stackable elements to form a connector and for assembling conductors to the elements which comprises;

means for supporting the connector during its assembly in which adjacently positioned elements are secured together to form a stack of elements and conductors are assembled to said elements;

a T-bar assembly for applying forces to each successively stacked element positioned in the supporting means to secure it to an adjacent element previously positioned in the supporting means and for applying forces to the conductors to assemble conductors to the elements;

means for mounting the T-bar assembly for up and down movement between a first and second position, the mounting means including:

first and second chambers with a passageway therebetween;

fluid contained with the first and second chambers and the passageway;

means in the first chamber responsive to the downward movement of the T-bar assembly for transferring fluid from the second chamber to the first chamber; and means for blocking the flow of fluid between the chambers to hold the T-bar assembly in a particular position.

14. A tool for assembling a connector including a plurality of elements, the tool comprising:

means for supporting connector elements during their assembly;

means for applying a force to a particular element positioned in the supporting means;

means for mounting the force applying means for reciprocal movement between a first and second position; the mounting means including:

first and second chambers with a passageway therebetween;

fluid contained within the first and second chambers and the passageway;

a piston positioned in one of the chambers responsive to the movement of the force applying means for transferring fluid from one chamber to another; and means for blocking the flow of fluid between the chambers to hold the force applying means in a particular position.

15. A tool for assembling a connector including a plurality of elements, the tool comprising:

means for supporting connector elements during their assembly;

means for applying a force to a particular element positioned in the supporting means;

the force applying means including:

an operating lever that in its rest position maintains a valve in an open condition;

the operating lever when moved from its rest position permitting the valve to close;

means for mounting the force applying means for reciprocal movement between a first and second position; the mounting means including;

first and second chambers with a passageway therebetween;

fluid contained within the first and second chambers and the passageway; and means responsive to the movement of the force applying means for transferring fluid from one chamber to another, the valve when closed blocking the flow of fluid between the chambers to hold the force applying means in a particular position.

16. A tool for assembling stackable elements to form a connector and for assembling conductors to the elements which comprises;

means for supporting the connector during its assembly in which adjacently positioned elements are secured together to form a stack of elements and conductors are assembled to said elements;

means for applying forces to each successively stacked element positioned in the supporting means to secure it to an adjacent element previously positioned in the supporting means and for applying forces to the conductor to assemble the conductors to the elements;

means for mounting the force applying means for up and down movement between a first and second position, the mounting means including:

first and second chambers with a passageway therebetween;

fluid contained within the first and second chambers and the passageway;

means in the first chamber responsive to the downward movement of the force applying means for transferring fluid from the second chamber to the first chamber;

means for preventing the force applied to a connector element by the force applying means from exceeding a predetermined level; and means for blocking the flow of fluid between the chambers to hold the force applying means in a particular position.

17. A tool for assembling stackable elements to form a connector and for assembling conductors to the elements which comprises;

means for supporting the connector during its assembly in which adjacently positioned elements are secured together to form a stack of elements and conductors are assembled to said elements;

means for applying forces to each successively stacked element positioned in the supporting means to secure it to an adjacent element previously positioned in the supporting means and for applying forces to the conductor to assemble the conductors to the elements;

means for mounting the force applying means for up and down movement between a first and second position, the mounting means including:

first and second chambers with a passageway therebetween;

fluid contained within the first and second chambers and the passageway;

means in the first chamber responsive to the downward movement of the force applying means for transferring fluid from the second chamber to the first chamber;

the first chamber means further includes a spring acting to return the fluid transferring means to an upward position whereby fluid is transferred back from the first chamber to the second chamber; and means for blocking the flow of fluid between the chambers to hold the force applying means in a particular position.

18. A tool for assembling stackable elements to form a connector and for assembling conductors to the elements which comprises;

means for supporting the connector during its assembly in which adjacently positioned elements are secured together to form a stack of elements and conductors are assembled to said elements;

means for applying forces to each successively stacked element positioned in the supporting means to secure it to an adjacent element previously positioned in the supporting means and for applying forces to the conductor to assemble the conductors to the elements;

means for mounting the force applying means for up and down movement between a first and second position, the mounting means including:

first and second chambers with a passageway therebetween;

fluid contained within the first and second chambers and the passageway;

means in the first chamber responsive to the downward movement of the force applying means for transferring fluid from the second chamber to the first chamber;

the fluid transferring means comprising a piston connected to the force applying means, the piston moving up and down with the force-applying means, the first chamber further includes a spring acting to return the piston and thereby the force applying means to an upward position whereby fluid is transferred back from the first chamber to the second chamber; and means for blocking the flow of fluid between the chambers to hold the force applying means in a particular position.

19. A tool for assembling stackable elements to form a connector and for assembling conductors to the elements which comprises;

means for supporting the connector during its assembly in which adjacently positioned elements are secured together to form a stack of elements and conductors are assembled to said elements;

means for applying forces to each successively stacked element positioned in the supporting means to secure it to an adjacent element previously positioned in the supporting means and for applying forces to the conductor to assemble the conductors to the elements;

means for mounting the force applying means for up and down movement between a first and second position, the mounting means including:

first and second chambers with a passageway therebetween;

hydraulic fluid contained within the first and second chambers and the passageway;

means in the first chamber responsive to the downward movement of the force applying means for transferring hydraulic fluid from the second chamber to the first chamber; and means for blocking the flow of hydraulic fluid between the chambers to hold the force applying means.

* * * * *